US008327675B2

(12) United States Patent
Baumann

(10) Patent No.: US 8,327,675 B2
(45) Date of Patent: Dec. 11, 2012

(54) LOCK CYLINDER AND MATCHING KEY

(75) Inventor: Andreas Baumann, Essen (DE)

(73) Assignee: C. Ed. Schulte Gesellschaft mit Beschrankter Haftung Zylinderschlossfabrik, Velbert (DE)

( * ) Notice: Subject to any disclaimer, the term of this patent is extended or adjusted under 35 U.S.C. 154(b) by 0 days.

(21) Appl. No.: 13/383,006

(22) PCT Filed: Jul. 1, 2010

(86) PCT No.: PCT/EP2010/059337
§ 371 (c)(1),
(2), (4) Date: Jan. 9, 2012

(87) PCT Pub. No.: WO2011/003798
PCT Pub. Date: Jan. 13, 2011

(65) Prior Publication Data

US 2012/0118032 A1 May 17, 2012

(30) Foreign Application Priority Data

Jul. 7, 2009 (DE) ..... 10 2009 026 117

(51) Int. Cl.
*E05B 27/06* (2006.01)
*E05B 27/10* (2006.01)

(52) U.S. Cl. ..... 70/494; 70/409; 70/495; 70/DIG. 25; 70/DIG. 54; 70/DIG. 55; 70/DIG. 74

(58) Field of Classification Search ..... 70/494–496, 70/409, 372, 378, 392, DIG. 21, DIG. 25, 70/DIG. 54, DIG. 55, DIG. 74
See application file for complete search history.

(56) References Cited

U.S. PATENT DOCUMENTS

| | | | | | |
|---|---|---|---|---|---|
| 225,808 | A | * | 3/1880 | Deitz | 70/496 |
| 1,594,033 | A | * | 7/1926 | Anakin | 70/493 |
| 2,232,137 | A | * | 2/1941 | Rolph | 70/493 |
| 2,460,551 | A | * | 2/1949 | Swanson | 70/495 |
| 3,479,849 | A | * | 11/1969 | Check | 70/495 |
| 3,693,384 | A | * | 9/1972 | Genakis | 70/493 |

(Continued)

FOREIGN PATENT DOCUMENTS

| | | |
|---|---|---|
| DE | 1678096 | 10/1971 |

(Continued)

*Primary Examiner* — Lloyd Gall
(74) *Attorney, Agent, or Firm* — Lucas & Mercanti, LLP; Klaus P. Stoffel

(57) ABSTRACT

A lock cylinder having: a cylinder core having a key channel for inserting a key which is provided with profiling; at least one feeler element which is disposed in the cylinder core, is acted on by a spring and is held in a blocking position by the spring when the key is not inserted in the key channel; and a blocking element which, when the feeler element is in the blocking position, is held in a blocking position which blocks rotation of the cylinder core. The feeler element can be shifted against the return force of the spring into a release position by the profiling on the matching key inserted into the key channel, in which position the locking element can be deflected into a position releasing the cylinder core. In order to enable the lock cylinder to lock more securely, the feeler element includes a feeler arm for feeling the profiling, which feeler arm protrudes radially from a shaft rotatably supported in the cylinder core and which feeler arm, when the matching key is inserted, is acted upon such that the shaft rotates about the axis thereof into the release position.

14 Claims, 9 Drawing Sheets

U.S. PATENT DOCUMENTS

| | | | | |
|---|---|---|---|---|
| 3,722,241 | A * | 3/1973 | Sussina | 70/495 |
| 3,726,116 | A * | 4/1973 | Di Motta | 70/493 |
| 4,450,699 | A * | 5/1984 | Genakis | 70/494 |
| 4,750,342 | A * | 6/1988 | Nakai | 70/496 |
| 4,756,177 | A | 7/1988 | Widen | |
| 4,998,426 | A * | 3/1991 | Genakis | 70/494 |
| 6,427,506 | B1 | 8/2002 | Prunbauer | |
| 6,526,791 | B2 * | 3/2003 | Shvarts | 70/419 |
| 7,690,231 | B1 * | 4/2010 | Field et al. | 70/283 |
| 2005/0061043 | A1 | 3/2005 | Widen | |

FOREIGN PATENT DOCUMENTS

| | | | |
|---|---|---|---|
| DE | 3024929 | A | 1/1981 |
| DE | 3609473 | | 10/1987 |
| EP | 1055788 | A | 11/2000 |

* cited by examiner

LOCK CYLINDER AND MATCHING KEY

The present application is a 371 of International application PCT/EP2010/059337, filed Jul. 1, 2010, which claims priority of DE 10 2009 026 117.6, filed Jul. 7, 2009, the priority of these applications is hereby claimed and these applications are incorporated herein by reference.

BACKGROUND OF THE INVENTION

The invention relates to a lock cylinder comprising a cylinder core which has a key channel for insertion of a key that is provided with a profiling, the lock cylinder also comprising at least one feeler member disposed in the cylinder core and acted on by a spring, the feeler member being held by the spring in a blocking position when a key is not inserted into the key channel, and the lock cylinder further comprising a blocking member which is held in a blocking position that blocks rotation of the lock cylinder when the feeler member is in its blocking position, the feeler member being drivable against the return force of the spring into a release position by the profiling of the matching key when this key is inserted into the key channel, in which release position the blocking member can be displaced into a position in which it unblocks the cylinder core.

The invention also relates to a locking device consisting of a lock cylinder and a matching key.

A lock cylinder with a matching key is described by DE 30 24 929. The lock cylinder has a cylinder housing that has a mounting bore in which the lock cylinder is enclosed, it being possible for the cylinder core to be rotated by insertion of a matching key into the key channel in order to rotate, upon insertion of the key, a locking member which is coupled to the cylinder core and by which a lock can be actuated. When no key is inserted, the cylinder core is blocked against rotation by tumblers. A multiplicity of tumblers, each of which has a housing pin and a core pin, lie in pin bores of a profile portion of the cylinder housing, these pin bores being aligned with core pin bores of the cylinder core. When no key is inserted, the housing pins cross over the dividing line between the cylinder core and the cylinder housing. In the generic cylinder core, there is a cylindrical feeler member, which is displaceable in the axial direction. The feeler member is held in a blocking position by a spring, in which position it prevents a displacement into a release position of a blocking member formed as a blocking bar. If the matching key is inserted into the key channel, not only the tumbler pins are sorted in such a way that the housing pins no longer cross over the dividing line. When the matching key is inserted, the feeler member is also displaced into a release position. For this, the feeler member senses a profile rib of the pin with the end face of the feeler member opposite from the end face acted on by the spring. When the key is fully inserted, the feeler member is displaced into a position such that the blocking member can be displaced into a position that unblocks the cylinder core. The cylinder core can then be turned.

DE 16 78 096 describes a lock cylinder having a cylinder housing and a cylinder core that is rotatably mounted in a bore of the cylinder housing. The core has a key channel into which a key can be inserted. The key shank of the key has notches for sorting core pins. The core pins have heads that are formed in the shape of the ridge of a roof and can enter into obliquely extending notches in the key shank and thereby assume a defined rotational position. The inserted matching key gives the core pins a rotational position such that projections of a blocking member can enter into radial cut-outs in the core pins, so that the blocking member, which effects a rotational blocking of the cylinder core when a key is not inserted, can move away radially inwards into a position in which it unblocks the rotatability of the cylinder core.

DE 36 09 473 A1 describes a lock cylinder in which the cylinder core is blocked against rotation by means of a double-armed blocking lever, which is pivotable into an unblocking position by insertion of a matching key. The lever is acted on by a compression spring and is controlled by a feeler pin that senses a profiling of the wide side of the key.

SUMMARY OF THE INVENTION

It is an object of the invention to improve the locking security of a lock cylinder.

First and foremost, it is proposed that the feeler member has a shank that is rotatably mounted in the cylinder core. Advantageously there are the following features: a feeler arm projects from this shank. The feeler arm senses the profiling of the key. When the matching key is inserted, the feeler arm slides along on the key shank and assumes a defined rotational position when the key has been fully inserted. The feeler arm then engages against an abutment flank of the key shank. The position of the abutment flank defines the rotational position of the shank. The matching key that has been fully inserted into the key channel gives the shank a rotational position such that the blocking member can be displaced into its unblocking position. For this, the feeler member has a cut-out which is preferably disposed on the side of the shank that faces away from the feeler arm. A projection of the blocking member can enter into this cut-out when the cut-out is aligned with the projection. When no key is inserted or a non-locking key is inserted, the cut-out is not aligned with the projection. Rather a blocking flank which prevents a radial escaping movement of the blocking member lies in front of the projection. The blocking flank is adjacent to the cut-out. The cut-out is preferably formed by a radial cut-out in the shank, the peripheral contour of the cut-out being only slightly greater than the peripheral contour of the associated projection of the blocking member. A rotated position of the shank has the effect that the projection cannot enter into the radial recess. The wall of the shank neighbouring the radial recess thus forms the blocking flank which, in the blocking position of the feeler member, lies in front of the projection, and which holds the blocking member in its blocking position. The feeler arm is formed by a head of the feeler member disposed at the end of the shank. This head may also form a supporting flank on which an arm of a leaf spring is supported, the leaf spring holding the feeler member in a blocking position or displacing the feeler back again into its blocking position after a rotation of the shank following withdrawal of the key. The cylinder core has radial cut-outs. A cut-out of this kind forms a pocket in which the blocking member is enclosed, the blocking member preferably being formed by a blocking bar. The blocking bar has obliquely extending blocking flanks, which, in the blocking position of the blocking member, engage against obliquely extending side walls of a blocking groove of the cylinder housing. If the cylinder core is rotated with the feeler members in the release position, the blocking flanks of the blocking member can then slide on are another which results in a radially inward displacement of the blocking member. This takes place against the restoring force of a return spring which otherwise urges the blocking member in the direction of the blocking groove. The blocking bar has a projection in the region of each of its two ends. A feeler member is associated with each projection. Preferably the cylinder core has two diametrically oppositely-disposed blocking members, with each of which there is associated one, preferably two, feeler members, so that not only the presence of one rib but also of two opposed ribs of the key shank can be sensed by the feeler arms of the feeler members. Each of the opposed profile ribs of the key shank has however also depressions which form abutment flanks. The flanks run obliquely to the direction of insertion of the key, so that the feeler members only then take up their release position when the key has been fully inserted, i.e. inserted into the key channel right up to an abutment position. For this, the key shank has an abutment which engages against the end face at the cylinder core at the key insertion end. The doubly-effective required confirmation by in each case the two feeler members can preferably be used in order, e.g. to detect the correct presence of a trademark protecting over-milling of the tip of the key.

The precise arrangement and formation of the abutment flanks for the blocking member arms within the confirmation rib results in a higher level of protection against cutting of copies.

An exemplary embodiment of the invention will be explained below with reference to accompanying drawings, in which:

BRIEF DESCRIPTION OF THE DRAWING

FIG. 7 shows an illustration corresponding to FIG. 4 with a key inserted;

DETAILED DESCRIPTION OF THE INVENTION

Figure 1:
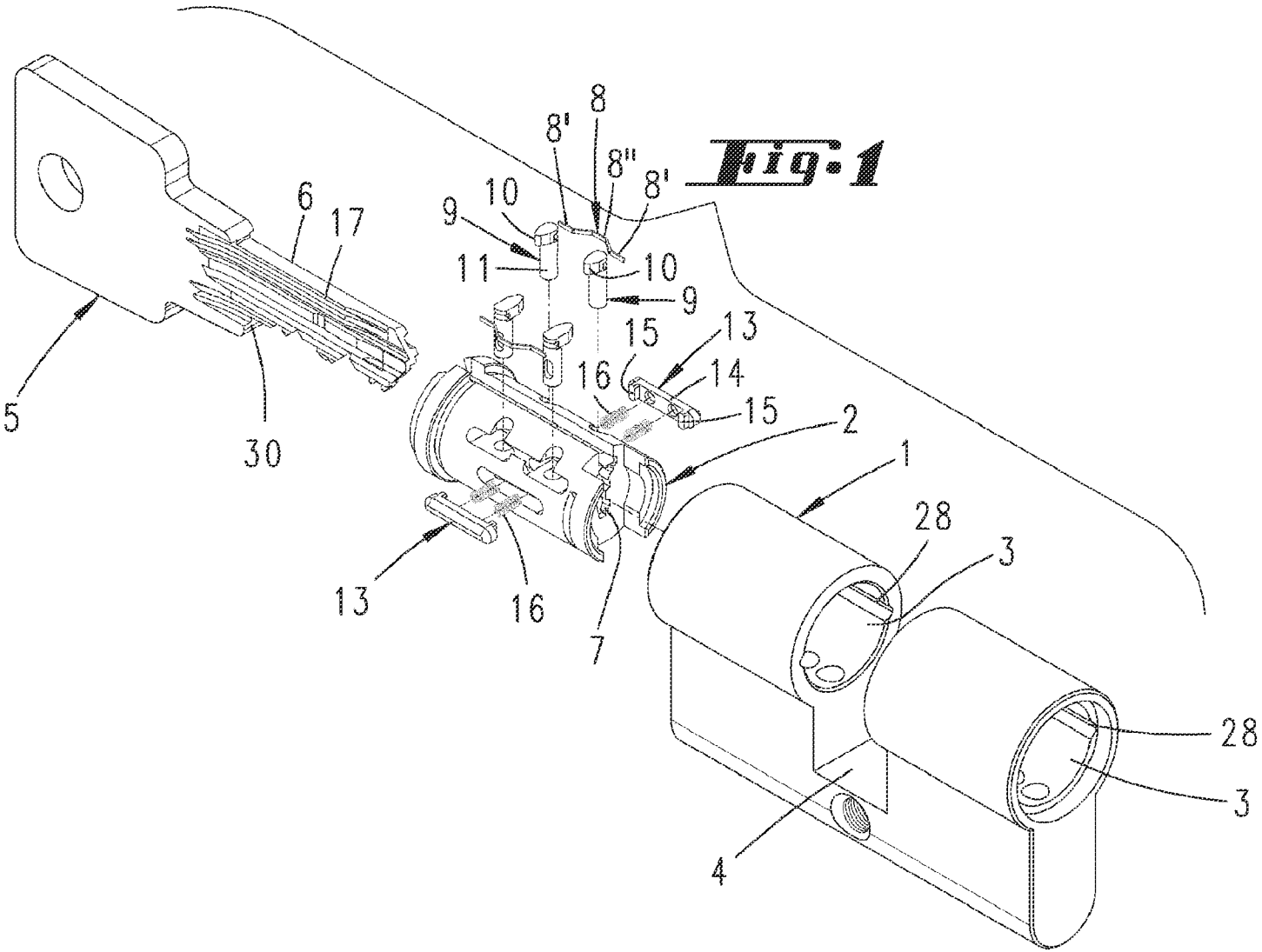
FIG. 1 shows an exploded illustration of a lock cylinder according to the invention with a matching key.

FIG. 1 shows the cylinder housing without cylinder core 2 inserted therein. In an assembled state, the cylinder core 2 is rotatably mounted in a bearing bore 3. In the exemplary embodiment, there is in question a double cylinder with a notch 4, disposed between two bearing bores 3, for receiving a locking member, not shown in the drawings, which is coupled to the cylinder core 2 for co-rotation, in order to actuate a lock by rotation of the cylinder core 2.

Also not shown in the drawings are the usual tumbler pins that consist in each case of a core pin and a housing pin and are enclosed in a spring-biased manner in pin bores. These interact with indentations cut into the key shank 6 of a key 5 on its narrow edge.

The cylinder core 2 has a key channel 7 provided with grooves and ribs for insertion of a correspondingly profiled shank 6 of a key 5. Profile ribs 17 extend in the direction of insertion of the key shank 6. For correct locking of the lock cylinder, the key 5 is inserted as far as an abutment position in which an abutment 30 of the key 5 engages against a counter-abutment 31 which is formed by the end face of the cylinder core 2.

Figure 2:
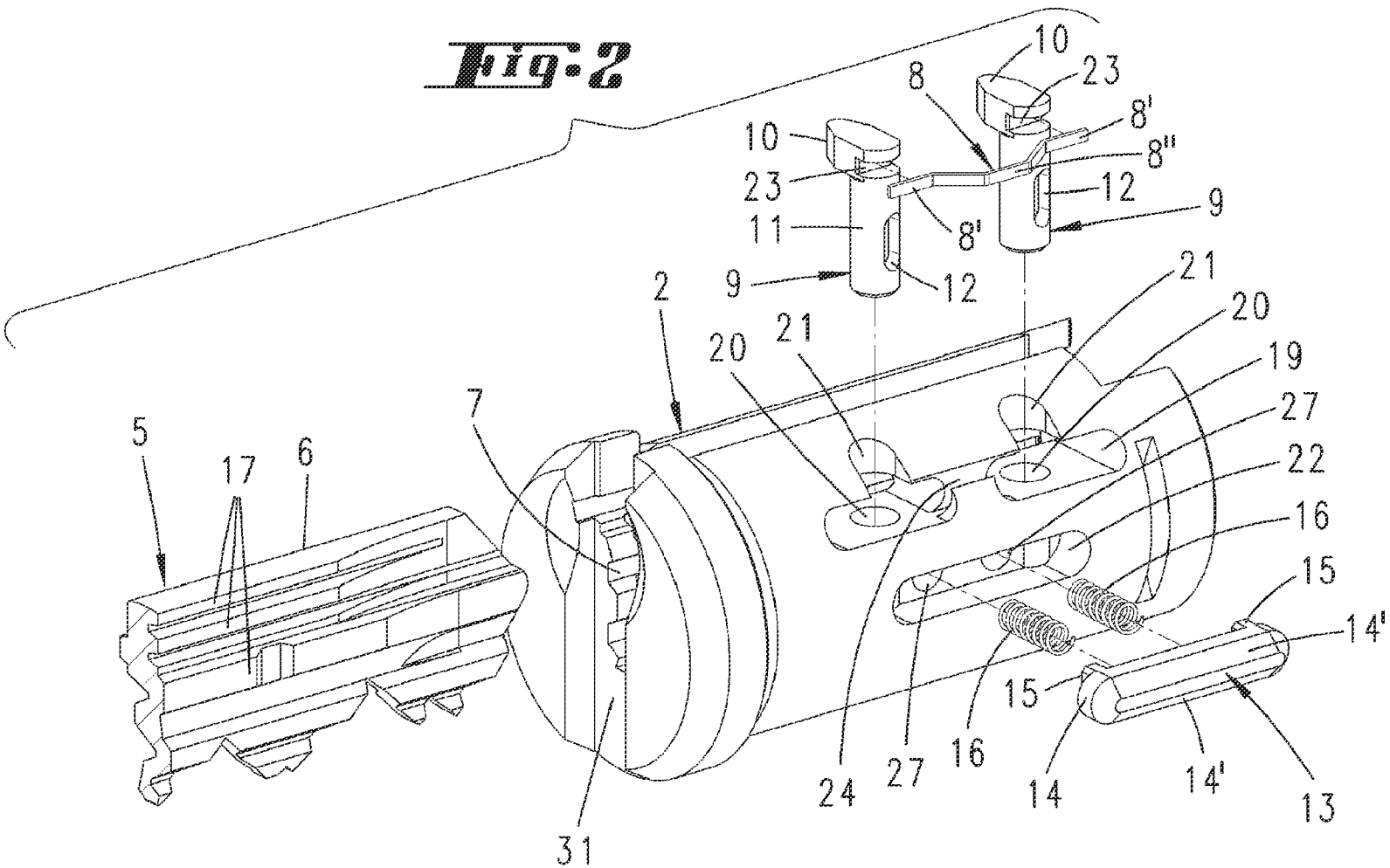
FIG. 2 shows an enlarged exploded illustration of the cylinder core.
Figure 3:
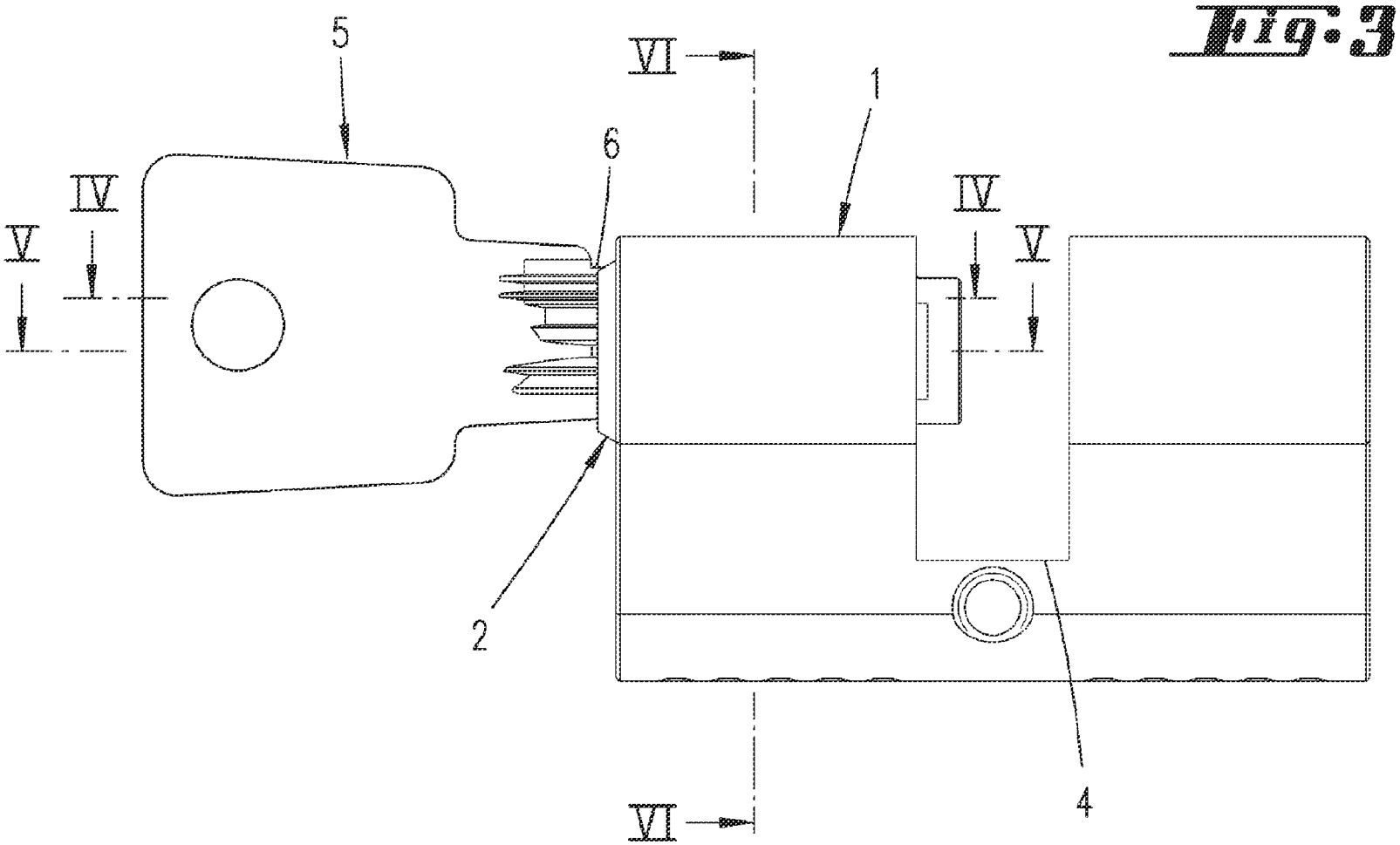
FIG. 3 shows the wide side view of a lock cylinder in which unimportant parts have been omitted for explanation of the invention and in which a key is inserted.
Figure 6:
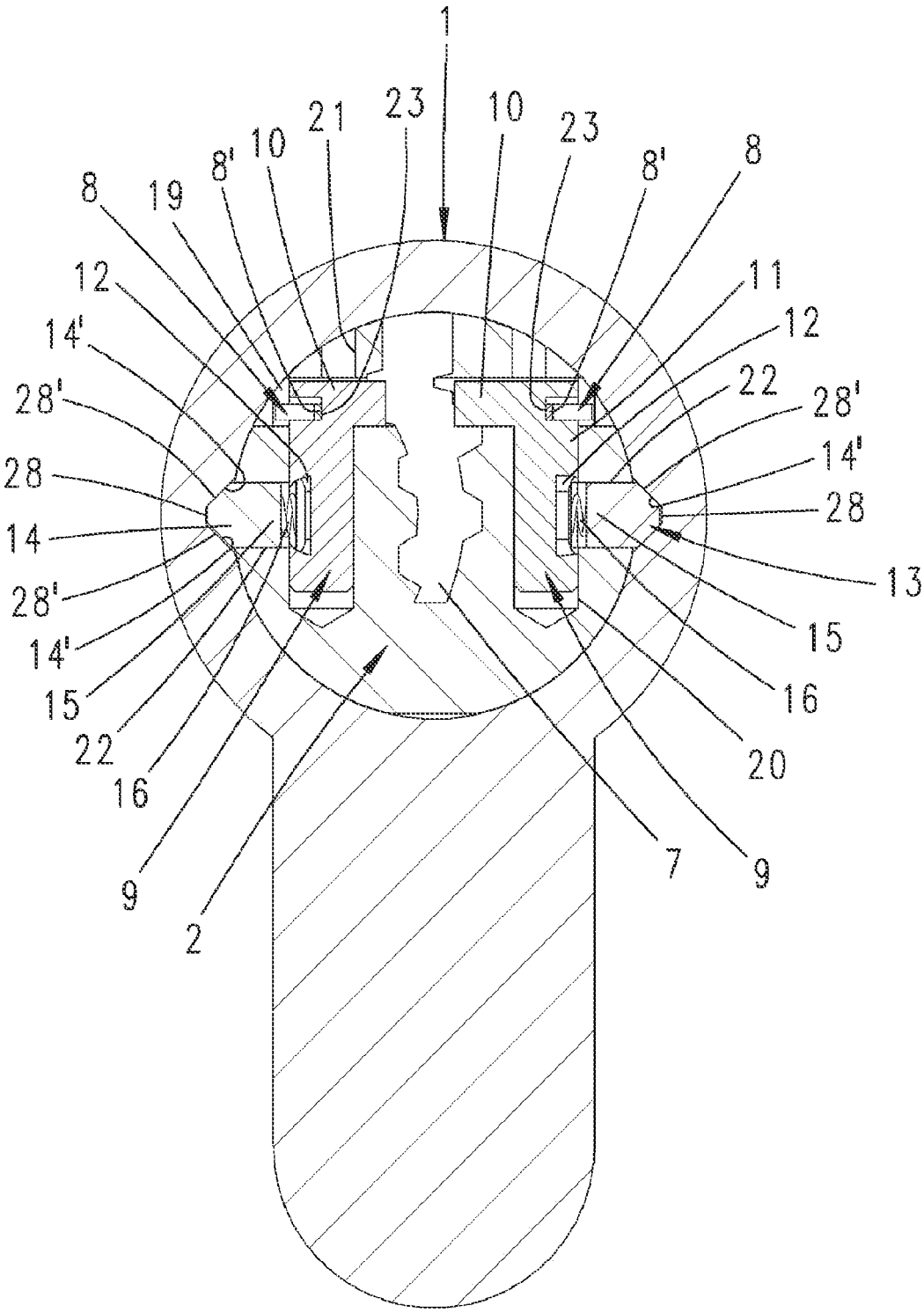
FIG. 6 shows a sectional illustration on the line VI-VI in FIG. 3 without a key inserted.
Figure 1:
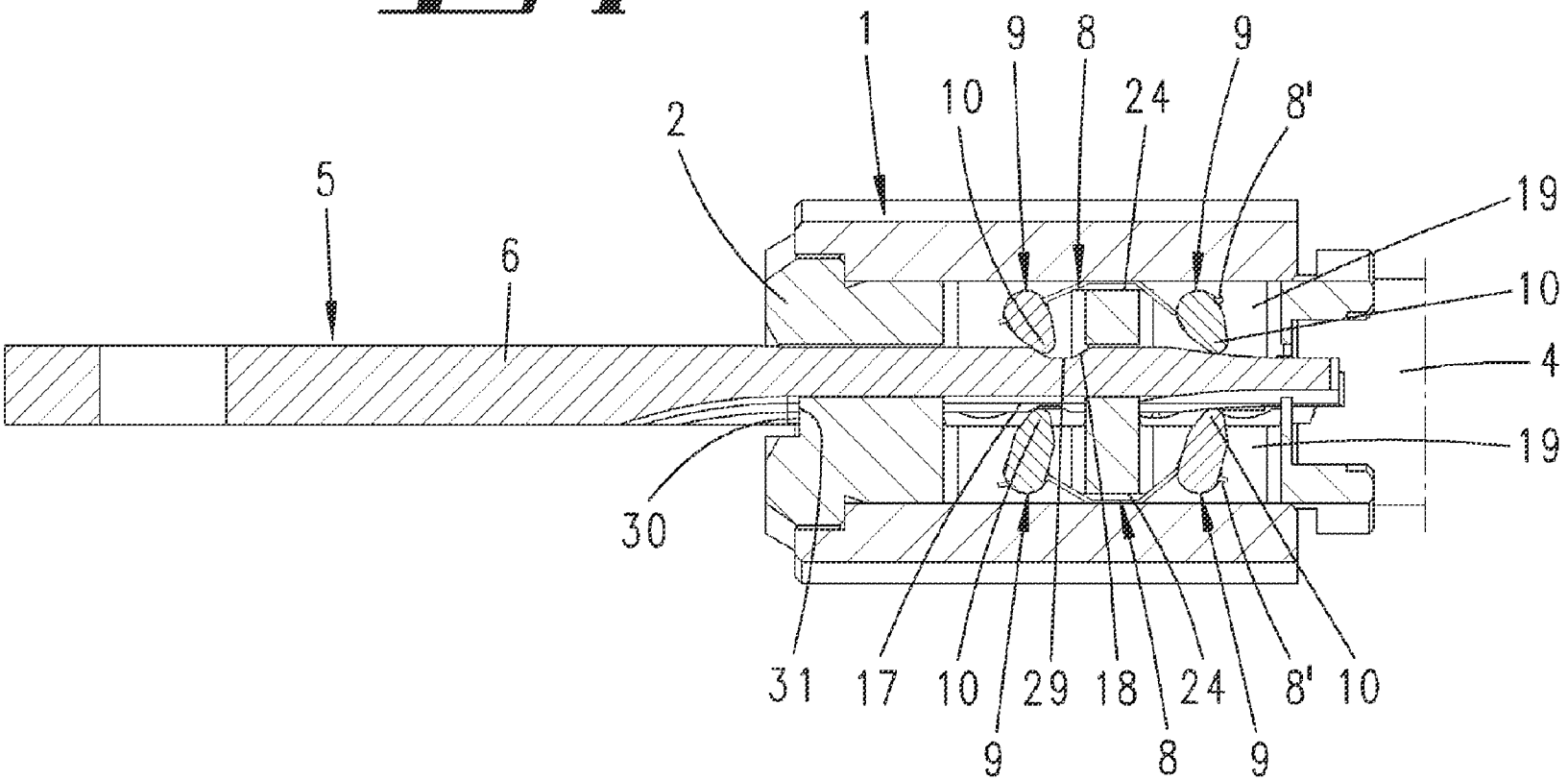

As is to be gathered from FIGS. 2 and 6 in particular, the cylinder core 2 has diametrically opposite pockets 22 that extend in the direction of extent of the cylinder core These pockets 22 are open towards the sleeve surface of the cylinder core 2 and form bearing pockets for in each case a blocking member 13.

The blocking member 13 forms a blocking bar 14 elongate extent, which provides sloping flanks 14'. In a blocking position of the blocking member 13, the sloping flanks 14' engage against sloping flanks 28' of a blocking groove 28, which is defined by the wall of the bearing bore 3. On the side of the blocking bar 14 opposite from the sloping flanks, two projections 15 extend from the blocking bar, each projection being in the region of a respective end of the blocking member 13.

Figure 5:
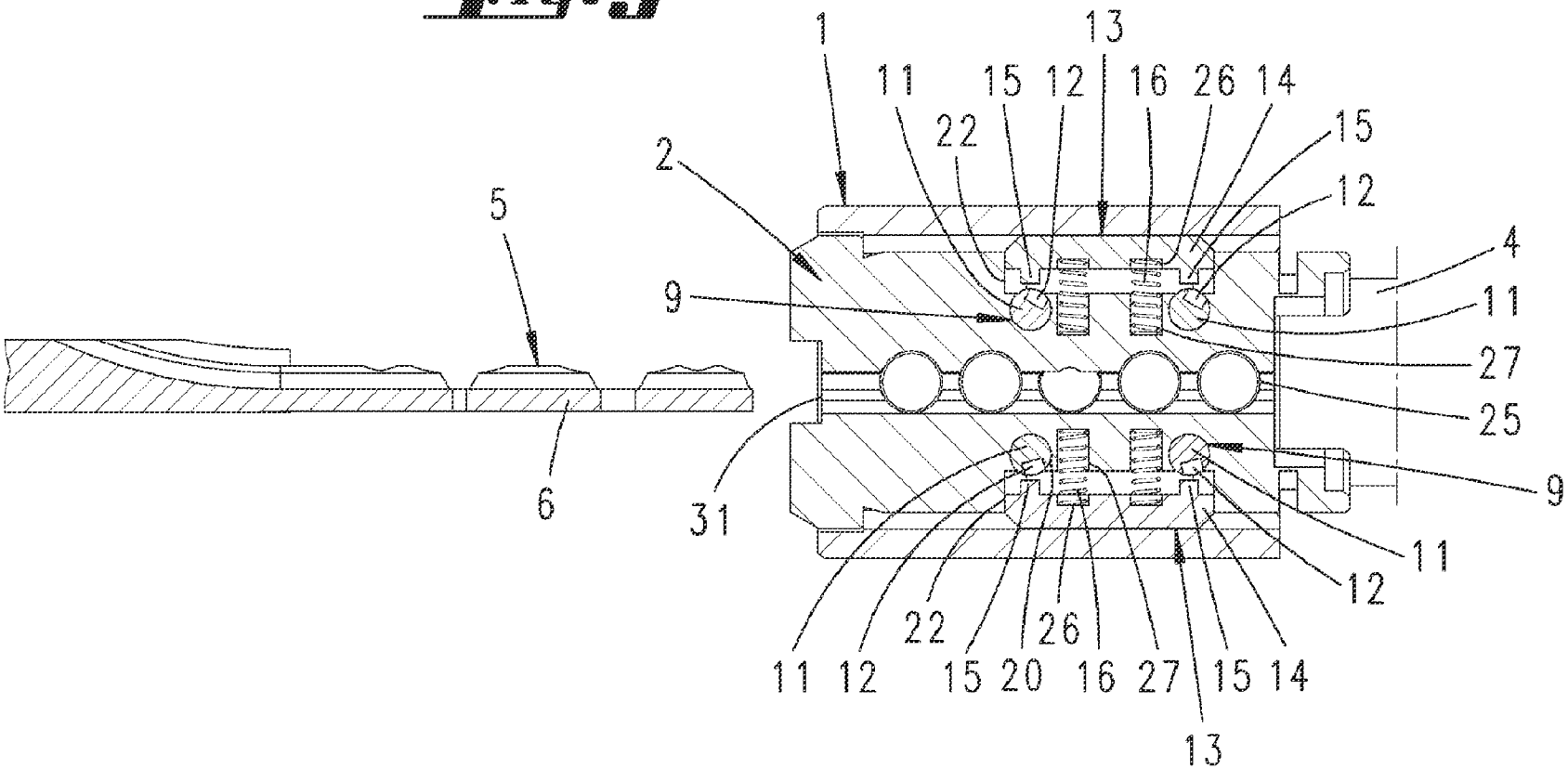
FIG. 5 shows a sectional illustration on the line V-V in FIG. 3 with a key not inserted.

It can be gathered from FIG. 5 that a compression spring 16 is in each case supported on the base of one of two recesses 26 that are disposed between the projections 15. The other ends of the compression springs 16 are inserted in recesses 27, that are provided by the base of the pocket 22. The springs 16 urge the blocking member 13 in the direction of a blocking position in which the blocking bar 14 is located in the blocking groove 28.

Two further recesses 19 correspond to each pocket 22, these recesses extending parallel to the pockets 22. Bearing bores 20 are in the walls of the recesses 19, these bores extending parallel to one another and running parallel to the walls of the key channel 7. The bearing bores 20 also run transverse to the direction in which the key is inserted, i.e. transverse to the longitudinal direction of the key channel 7.

The shanks 11 of feeler members 9 are rotatably mounted in the bearing bores 20. In order to fit the feeler members 9 to the cylinder core 2, mounting cut-outs 21 are provided in alignment with the bearing bores 20, through which the heads of the feeler members 9 also pass through, when feeler arms 10 formed by the heads are brought into a corresponding rotational position.

Figure 4:
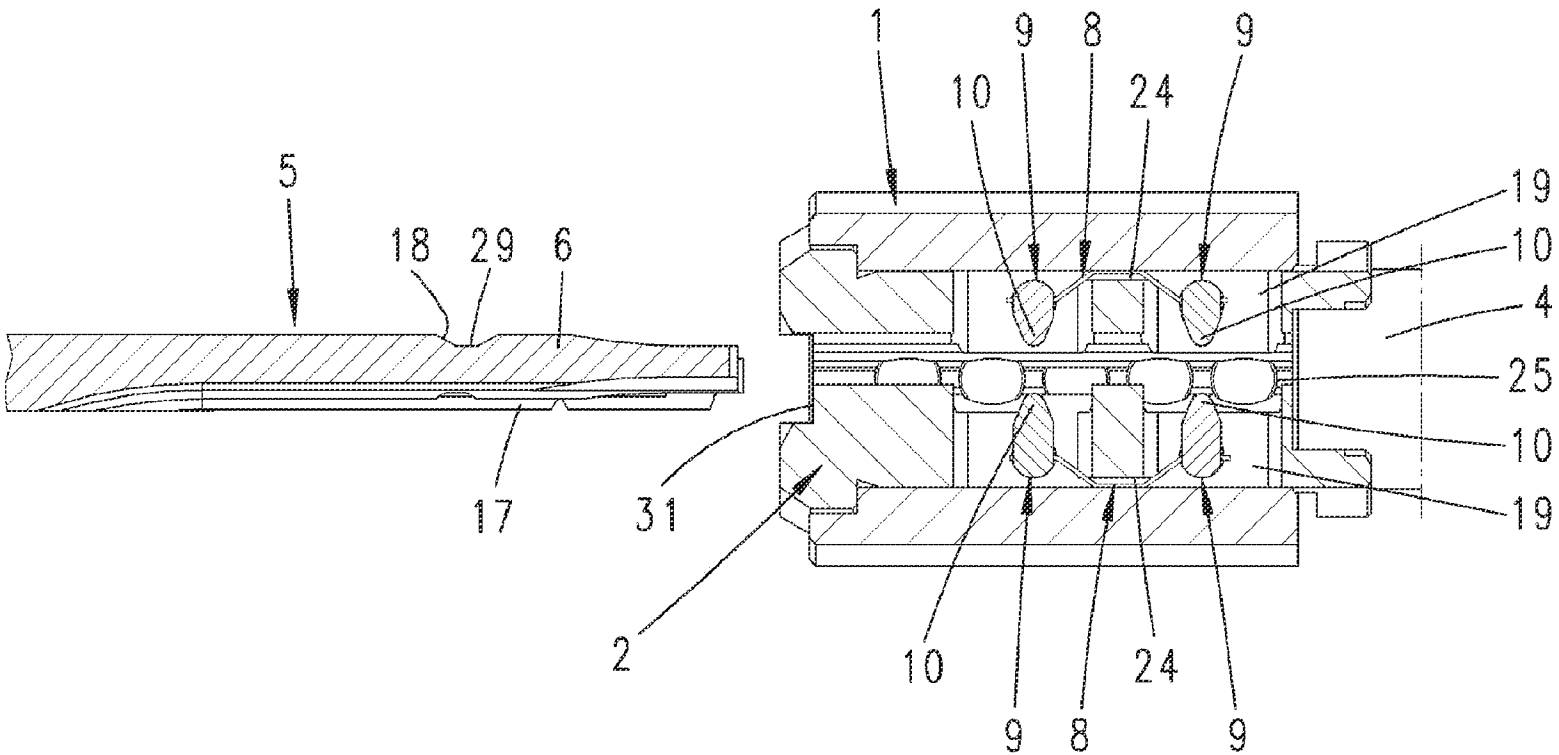
FIG. 4 shows a sectional illustration on the line IV-IV in FIG. 3 with a key not inserted.

The shanks 11 project as far as beyond the bearing pocket 22 in extensions of the bearing bores 20 in such a way that radial cut-outs 12 in the shanks 11 lie in the region of the bearing pocket 22. The radially projecting feeler arms 10 reach into the key channel 7 when a key is not inserted (compare FIG. 4). As can be gathered from FIG. 5, in this position, the radial cut-outs 12 of the shanks 11 lie out of alignment with the projections 15, so that the projections 15 cannot reach into the radial cut-outs 12. This has the effect that the blocking members 13 are held in their blocking position in which they block the rotatability of the cylinder core 2. The regions beside the radial cut-outs 12 of the shank 11 thus form blocking flanks against which the projections 15 abut when rotation is attempted.

The positioning of the feeler members 9 in their blocking position (FIG. 4) is effected by means of a leaf spring 8. For this, a central portion of the leaf spring 8 lies in a bearing slot 24 which is between two recesses 19. The two end portions 8', project from the central portion 8" and engage against supporting flanks 23, i.e. each end portion engaging one flank, of the feeler member 9 that run approximately in a straight line and go through the center of rotation. The supporting flanks 23 are formed by she bases of grooves which are in the head of the feeler member 9 at the rear of the feeler arm 10.

The manner in which the lock cylinder functions is as follows:

When no key has been inserted (compare FIGS. 4 to 6), the feeler arms 10 of the total of four feeler members 9 project into the key channel. The spacing between two feeler arms 10 that are opposite one another is less than the spacing of two ribs 17 of a key shank 6 at this point. The radial cut-out 12 of each shank 11 lies out of an aligned position with the associated projection 15 of the blocking member 13, so that the blocking member 13 cannot, be displaced out of its blocking position shown in FIG. 6 when the cylinder core 2 is rotated.

The matching key 5 has a key bow and a key shank 6 that projects from the key bow. The profile ribs 17 run along the key shank 6. In regions in which the feeler arms 10 are locally disposed when the key shank 6 is fully inserted into the key channel 7, the profile ribs 17 have depressions 29. The edges of the depressions 29 form abutment flanks 18 that run obliquely to the direction of insertion of the key 5 into the key channel 7.

Figure 8:
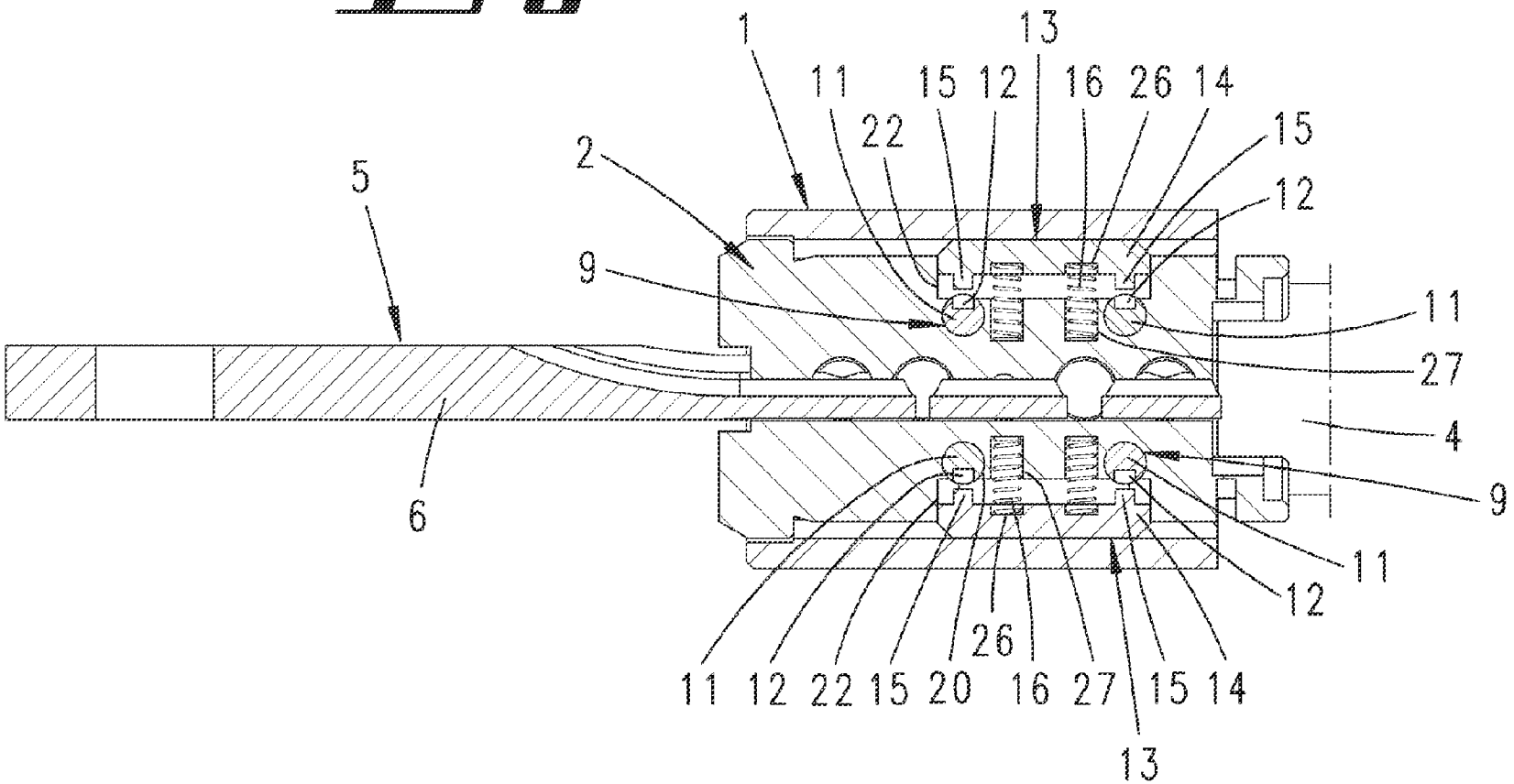
FIG. 8 shows an illustration corresponding to FIG. 5 with a key inserted.

If the matching key is inserted fully into the cylinder core 2, as FIGS. 7 and 8 show, the feeler arms 10 engage into the depressions 29. The depression at the tip of the key has only a single wall, which forme an abutment flank 18 against which a feeler arm 10 engages. In the fully inserted position of the key, in which the abutment 30 engages against the counter-abutment 31, the feeler members 9 assume a defined rotational position by virtue of engagement of their feeler arms 10 against the respective abutment flank 18.

FIG. 8 shows that in this rotational position the radial cut-outs 12 are aligned with the projections 15.

Figure 9:
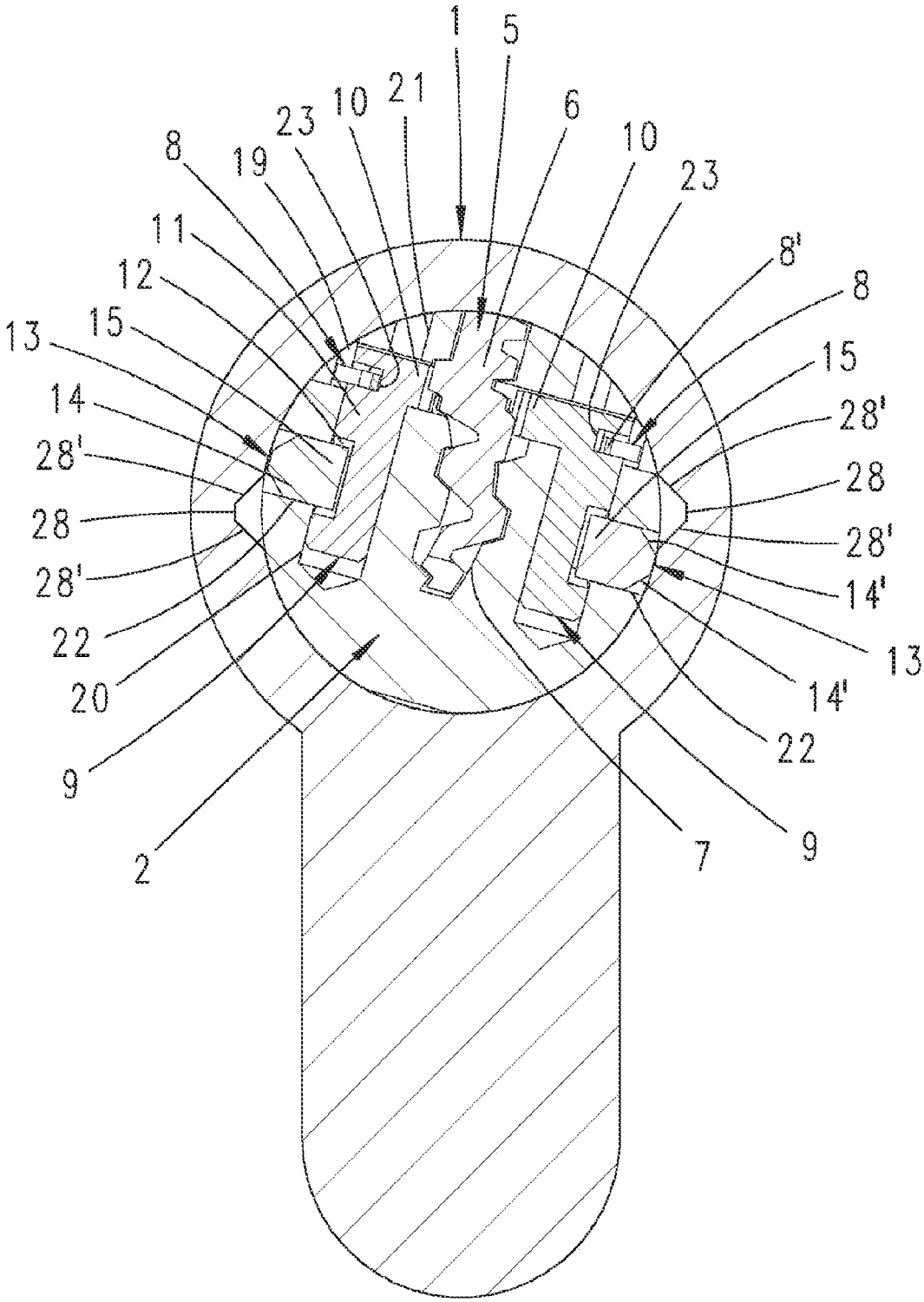
FIG. 9 shows an illustration corresponding to FIG. 6 with a key inserted.

If there is a slight rotation, by turning the key 5, starting from this position of the cylinder core 2, as FIG. 9 shows, the projections 15 can then enter into the radial cut-outs 12. This is effected by sliding against one another of the sloping flanks 14' of the blocking bar 14 on the sloping flanks 28' of the blocking groove 28. In this way, the blocking bar 14 is displaced fully out of the blocking groove 28.

If the cylinder core 2 is brought back again into a key withdrawal position, the key 5 can drawn out again from the key channel 7. The spring 8 rotates the feeler members 9 back into their blocking position in which the radial cut-outs 12 no longer lie in an aligned position with the projections 15. The blocking member 13 is brought back into its blocking position by the compression springs 16, in which position the blocking bar 14 is located in the blocking groove 28.

A key without depressions 29 but with a rib profile which corresponds to the cross-sectional profile of the key channel 7 can in fact be inserted into the key channel 7. If this key also has the correct notches on its narrow edge, then the tumbler pins, which are not shown, can also be brought into an opening position by this key. The feeler members 9 are however turned beyond and out of their release position so that the radial cut-outs 12 are not aligned with the projections of the blocking bar 14 that are associated with the cut-outs. Rather, the projections 15 of the blocking bar lie opposite blocking flanks formed by the edges of the radial cut-outs 12, these flanks preventing a displacement of the blocking bar 14 into its release position.

Not only recesses in the wide side of the key can be sensed by the feeler members, thus in particular the previously mentioned recesses in a key rib. In the simplest case, the presence of a rib with a specific rib height can be sensed by one of the above-described feeler members. A rib that has an insufficient rib height is not able to turn the feeler member into the release position. A higher rib rotates the feeler member beyond the release position.

All features disclosed are in themselves pertinent to the invention. The disclosure content of the associated/accompanying priority documents is also hereby incorporated in full in the disclosure of the application, including for the purpose of incorporating features of these documents in claims of the present application. In the optionally dependent way in which they are worded, the subclaims characterize independent inventive developments of the prior art, in particular in order for divisional applications to be filed on the basis of these claims.

The invention claimed is:

1. A lock cylinder, comprising: a cylinder core which has a key channel for insertion of a matching key that is provided with a profiling; at least one feeler member disposed in the cylinder core and acted on by a spring, the at least one feeler member be held by the spring in a blocking position when a key is not inserted into the key channel; and a blocking member held in a blocking position that blocks rotation of the cylinder core when the at least one feeler member is in its blocking position, the at least one feeler member being drivable against the return force of the spring into a release position by the profiling of the matching key when the key is inserted into the key channel, in which release position the blocking member is displaceable into a position in which the blocking member unblocks the cylinder core, the at least one feeler member having a feeler arm for sensing the profiling, the arm projecting radially from a shank that is mounted rotatably in the cylinder core, the feeler arm being acted on when the matching key is inserted so that the shank rotates about its axis into the release position, wherein the spring engages against a supporting flank of the shank so that the at least one feeler member is turned into the blocking position by withdrawal of the matching key from the key channel, wherein the spring is a leaf spring which has an end portion supported on the supporting flank in order to displace the at least one feeler member back into the blocking spring is arranged to act in a radial direction on the supporting flank.

2. The lock cylinder according to claim 1, wherein a central portion of the spring lies in a bearing slot between two recesses and two end portions project from the central portion, and engage against supporting flanks of two feeler members.

3. The lock cylinder according to claim 1, wherein the supporting flank is formed by a base of a groove, which is in a head of the at least one feeler member at a rear of the feeler arm.

4. The lock cylinder according to claim 1, wherein the leaf spring has a substantially Z-shaped configuration with end portions that run, in the blocking position of the at least one feeler member, substantially through a center of rotation of the at least one feeler member.

5. The lock cylinder according to claim 1, wherein the at east one feeler member has a cut-nut on the side that faces away from the feeler arm into which cut-out a projection of the blocking member can enter in the release position, and a blocking flank lying adjacent to the cut-out, the blocking flank lying in front of the projection in the blocking position of the at least one feeler member.

6. The lock cylinder according to claim 1, wherein the at least one feeler member has, at an end of the shank that acts as a rotary bearing, a head that forms the feeler arm.

7. The lock cylinder according to claim 5, wherein the cut-out is formed as a radial recess in the shank and the blocking flank is formed by the wall of the shank.

8. The lock cylinder according to claim 1, wherein a direction of a rotational axis of the shank runs transverse to a longitudinal direction of a shank of the key and parallel to a plane of a wide side of the key.

9. The lock cylinder according to claim 1, wherein the blocking member is a blocking bar that extends in a direction in which the key is inserted and is enclosed in a pocket of the cylinder core, the blocking bar having a projection in a region of each of its ends, each projection interacting with a feeler member.

10. The lock cylinder according to claim 1, comprising two substantially oppositely-disposed blocking members, each of which respectively interacts with at least one feeler member.

11. The lock cylinder according to claim 10, wherein each of the blocking members interacts with two feeler members.

12. A lock device comprising: a lock cylinder according to claim 1; and a matching key which has a shank and rib on a wide side of the key shank, the rib being sensed by the feeler arm when the shank of the key is inserted into the key channel.

13. The lock device according to claim 12, wherein the profiling is formed by an abutment surface of the key that runs transversely or obliquely with respect to a direction of insertion of the key, the feeler arm engaging against the abutment surface when the key is inserted fully into the key channel.

14. The lock device according to claim 13, wherein the abutment surface is a wall of a depression in the rib of the key shank.

* * * * *